US006597091B2

(12) United States Patent
Choi

(10) Patent No.: US 6,597,091 B2
(45) Date of Patent: Jul. 22, 2003

(54) HALOGEN LAMP SUPPORTING DEVICE

(75) Inventor: Gun-Young Choi, Incheon-shi (KR)

(73) Assignees: IC Tech Co., Ltd, Incheon-shi (KR); Key-Young Choi, Incheon-shi (KR)

( * ) Notice: Subject to any disclaimer, the term of this patent is extended or adjusted under 35 U.S.C. 154(b) by 0 days.

(21) Appl. No.: 10/073,210

(22) Filed: Feb. 13, 2002

(65) Prior Publication Data

US 2002/0113537 A1 Aug. 22, 2002

(30) Foreign Application Priority Data

Feb. 16, 2001 (KR) ..... 2001-3942 U

(51) Int. Cl.[7] ..... H01J 5/48
(52) U.S. Cl. ..... 313/318.01; 313/318.09
(58) Field of Search ..... 313/318.01, 318.07, 313/318.09, 318.1

(56) References Cited

U.S. PATENT DOCUMENTS 6,188,836 B1 2/2001 Glucksman et al.
6,205,677 B1 3/2001 Yune
2002/0003952 A1 1/2002 Choi

FOREIGN PATENT DOCUMENTS

EP 577 196 A 1/1994

*Primary Examiner*—Vip Patel
(74) *Attorney, Agent, or Firm*—Smith Patent Office

(57) ABSTRACT

Disclosed is a halogen lamp supporting device including a base having accommodating holes into which fitting end plates of a halogen lamp are respectively fitted and slits which are defined at opposite sides of each fitting slot, and elastic supporting members each having supporting strips which are tightly fitted around an associated end of the halogen lamp and fixing levers which are integrally formed with one of the supporting strips and fitted into the slits of the base to support the halogen lamp, the accommodating holes being defined in the base at halogen lamp supporting positions, respectively, so that the fitting end plate and the elastic supporting member can be simultaneously accommodated in each accommodating hole, and the slits, into which the fixing levers are to be fitted, being defined on bottom surfaces of the accommodating holes.

1 Claim, 6 Drawing Sheets

HALOGEN LAMP SUPPORTING DEVICE

BACKGROUND OF THE INVENTION

1. Field of the Invention

The present invention relates to a halogen lamp supporting device, and more particularly to a halogen lamp supporting device in which its base adapted to support a halogen lamp has accommodating holes each adapted to simultaneously receive an elastic support member and a fitting end plate of the halogen lamp for preventing impact from being applied to the halogen lamp.

2. Description of the Related Art

Referring to FIG. 1, a typical halogen lamp support device used for heaters is illustrated. As shown in FIG. 1, the halogen lamp support device includes a base 6 having fitting slots 5 to support a halogen lamp 1, and a reflection plate 7 for supporting the base 6. The halogen lamp 1 has fitting end plates 2 fitted in the fitting slots 5 of the base 6 while being bonded to the base 6 by a bonding cement. Of course, electric power has to be applied to the halogen lamp 1 via a wire 3. As shown in FIG. 2, the halogen lamp 1 includes a lamp tube 4 in which a heater coil 8 is received. The lamp tube 4 is filled with halogen gas 9. When electric power is applied to the halogen lamp 1, current flows through the heater coil 8, thereby causing the heater coil 8 to generate heat. Referring to FIG. 3 the cross section of the halogen lamp 1 in a coupled state of FIG. 1 is illustrated. As shown in FIG. 3, the fitting end plates 2 of the halogen lamp 1 is tightly fitted in the fitting slots 5 of the base 6, respectively. Since the fitting end plates 2 are thin, and there is no impact absorbing means, the halogen lamp 1 may be laterally moved, as indicated by dotted-line arrows in FIG. 3, when it is subjected to impact. As a result, the fitting end plates 2 may be broken, and separated from the body of the halogen lamp 1. In this case, the life of the halogen lamp is reduced.

In order to solve such a problem, an improved halogen lamp supporting device has been proposed, in which elastic supporting members adapted to provide an elastic force are provided at a base for supporting a halogen lamp, in order to elastically support the halogen lamp, so that the life of the halogen lamp is greatly increased. This halogen lamp supporting device is illustrated in FIG. 4. In FIG. 4, elements respectively corresponding to those in FIG. 1 are denoted by the same reference numerals. As shown in FIG. 4, which is an enlarged perspective view, the halogen lamp supporting device includes a base 6 having fitting slots 5 to support a halogen lamp 1. The base 6 also has slits 5-1 formed at opposite sides of each fitting slot 5. The halogen lamp supporting device also includes elastic supporting members 10 respectively mounted to the base 6 around the fitting slots 5 and provided with fitting portions to be fitted in the associated slits 5-1. Each elastic supporting member 10 includes an arc-shaped support strip 20 having an engagement protrusion 21 and an engagement hole 22 at each end thereof. The support strip 20 is tightly fitted around an associated end of the halogen lamp 1 via an insulating cloth 1-1. Each elastic supporting member 10 also includes an assistant support strip 30 having fixing levers 31 to be fitted in the slits 5-1 associated with the elastic supporting member 10, and a bent piece 40 for vertically coupling the support strip 20 and the assistant support strip 30. A fixing protrusion 32 is formed at the end of each fixing lever 31. In a state in which each fixing lever 31 is fitted in the associated slit 5-1, the fixing protrusion 32 of the fixing lever 31 is bent to fix the fixing lever 31.

FIG. 5 is an enlarged cross-sectional view taken along the line A—A of FIG. 4. FIG. 6 is an enlarged cross-sectional view taken along the line B—B of FIG. 4. As shown in FIGS. 5 and 6, the fitting end plates 2 of the halogen lamp 1 is tightly fitted in the fitting slots 5 of the base 6, respectively. Each arc-shaped support strip 20 is tightly fitted around an associated end of the halogen lamp 1 via the insulating cloth 1-1 in a state in which the engagement protrusion 21 is engaged with the engagement hole 22, in order to stably support the halogen lamp 1. The support strip 20 supports the assistant support strip 30 via the bent piece 40 so as to allow the assistant support strip 30 to have an elastic force. The assistant support strip 30 is in contact with the upper surface of the base 6 at its lower surface. The fixing levers 31 extending downwardly from the assistance support strip 30 are inserted into the fixing lever slits 5-1, respectively. In a state in which each fixing lever 31 is completely inserted in the associated fixing lever slit 5-1, its fixing protrusion 32 is outwardly protruded from the lower surface of the base 6. Accordingly, the fixing lever 31 can be fixed to the base 6 by bending the protruded fixing protrusion 32.

In other words, each support strip 20 is coupled to the halogen lamp 1, whereas each assistant support strip 30 is fixedly mounted to the base 6. In this state, the support strips 20 and 30 exhibit an elastic force in cooperation with each other because they are connected by the bent piece 40. For example, in the case of FIG. 5, when the halogen lamp 1 is subjected to impact, it tends to move to a position a or b. In accordance with such a tendency, the halogen lamp 1 comes into contact with the upper surface of the base 6, so that cracks may be formed at the boundary of each fitting end plate 2 and the body of the halogen lamp 1. However, the support strip 20 serves to prevent such a crack formation. That is, the bent piece 40 connecting the support strips 20 and 30 has a bent strip structure to maintain an elastic force, so that it can absorb impact.

Also, the halogen lamp 1 may tend to move to a position c or d when it is subjected to external impact. At this time, it is possible to prevent cracks from being formed at the boundary of each fitting end plate 2 and the body of the halogen lamp 1. That is, when the halogen lamp 1 may tend to move to the position c or d, it is supported by each support strip 20 via the insulating cloth 1-1. The support strip 20 is coupled to the assistant support strip 30 by the bent piece 40. The assistant support strip 30 is fixed to the base 6 by its fixing levers 31 and fixing protrusions 32. A certain gap g is defined between the fitting slot 5 and the fitting end plate 2 in order to allow the fitting end plate 2 to be slightly movable within the fitting slot 5, as shown in FIGS. 5 and 6. Accordingly, it is possible to reduce impact generated when the fitting end plate 2 comes into contact with the inner wall of the fitting slot 5 due to external impact applied to the halogen lamp 1. In this construction, however, each fixing lever 31 has to be fitted in the associated fixing lever slit 5-1. However, the fitting process is difficult. In this case, although there is an improvement in impact resistance, the improvement is insufficient. Furthermore, there is a limitation to prevent vibrations due to the width of the fitting slot 5.

SUMMARY OF THE INVENTION

Therefore, the present invention has been made in view of the above mentioned problems, and an object of the invention is to provide a halogen lamp supporting device capable of achieving an improvement in anti-vibration.

In accordance with the present invention, this object is accomplished by providing a halogen lamp supporting device comprising a base having accommodating holes into which fitting end plates of a halogen lamp are respectively fitted and slits which are defined at opposite sides of each fitting slot; and elastic supporting members each having supporting strips which are tightly fitted around an associated end of the halogen lamp and fixing levers which are integrally formed with one of the supporting strips and fitted into the slits of the base to support the halogen lamp, the accommodating holes being defined in the base at halogen lamp supporting positions, respectively, in a manner such that the fitting end plate and the elastic supporting member can be simultaneously accommodated in each accommodating hole, and the slits, into which the fixing levers are to be fitted, being defined on bottom surfaces of the accommodating holes.

BRIEF DESCRIPTION OF THE DRAWINGS

The above objects, and other features and advantages of the present invention will become more apparent after a reading of the following detailed description when taken in conjunction with the drawings, in which.

DESCRIPTION OF THE PREFERRED EMBODIMENTS

Figure 1:
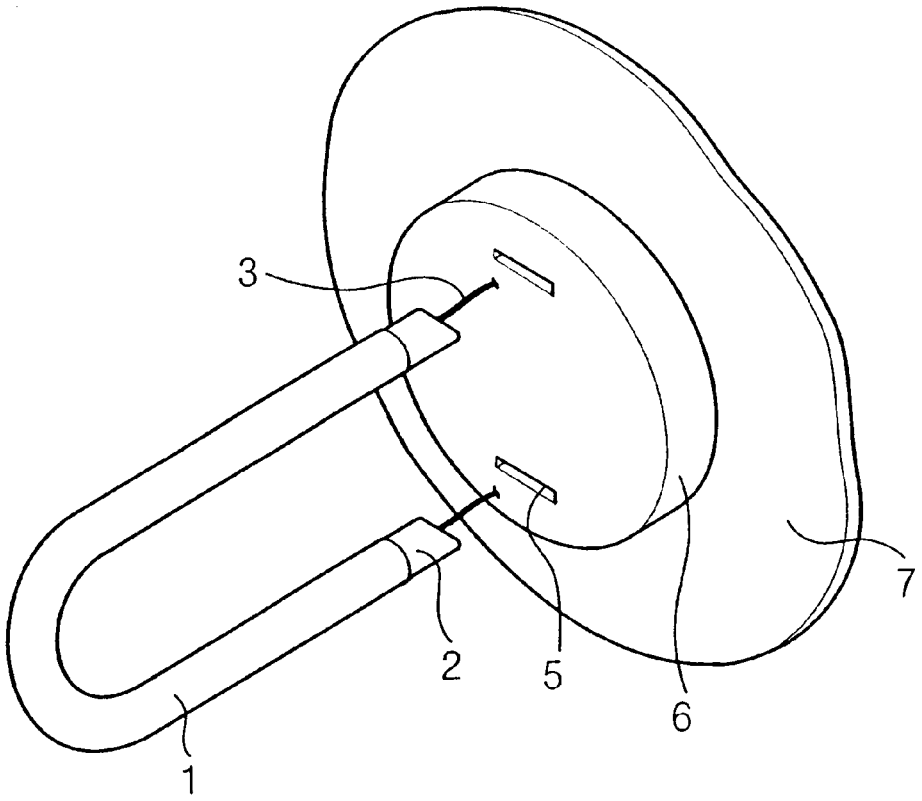
Fig. 1 PRIOR ART
FIG. 1 is an exploded perspective view illustrating a typical halogen lamp, and a base for supporting the halogen lamp.
Figure 2:
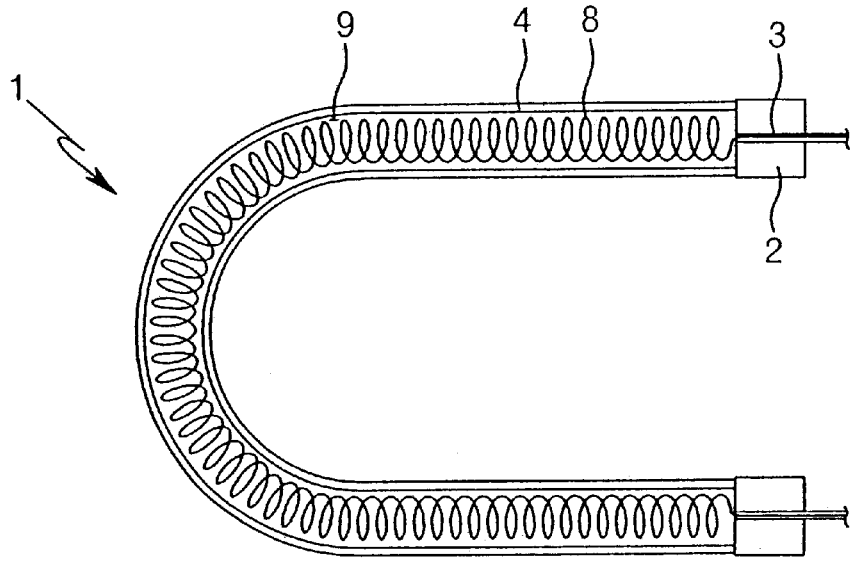
Fig. 2 PRIOR ART
FIG. 2 is a sectional view illustrating the halogen lamp of FIG. 1.
Figure 3:
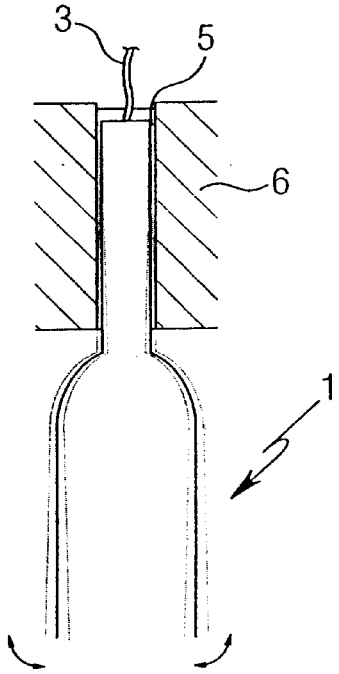
Fig. 3 PRIOR ART
FIG. 3 is an enlarged sectional view illustrating an coupled state of the halogen lamp.
Figure 4:
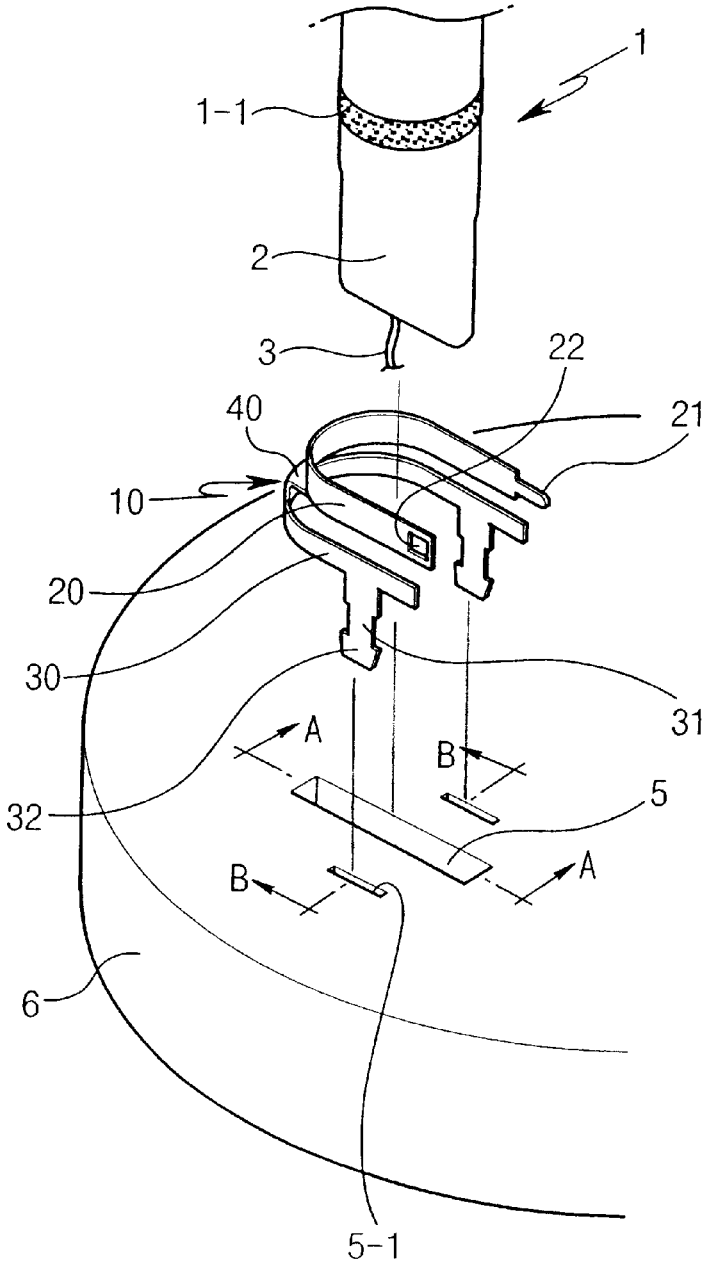
Fig. 4 PRIOR ART
FIG. 4 is an exploded perspective view illustrating another halogen lamp support device.
Figure 5:
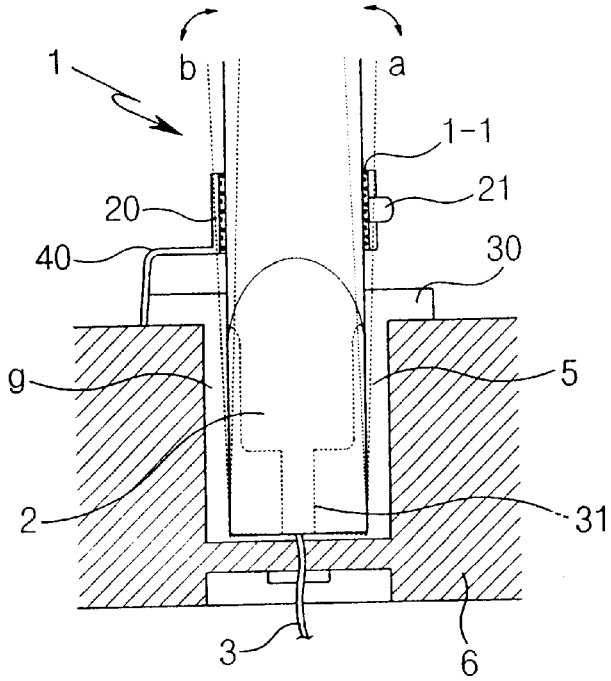
Fig. 5 PRIOR ART
FIG. 5 is an enlarged cross-sectional view taken along the line A—A of FIG. 4.
Figure 6:
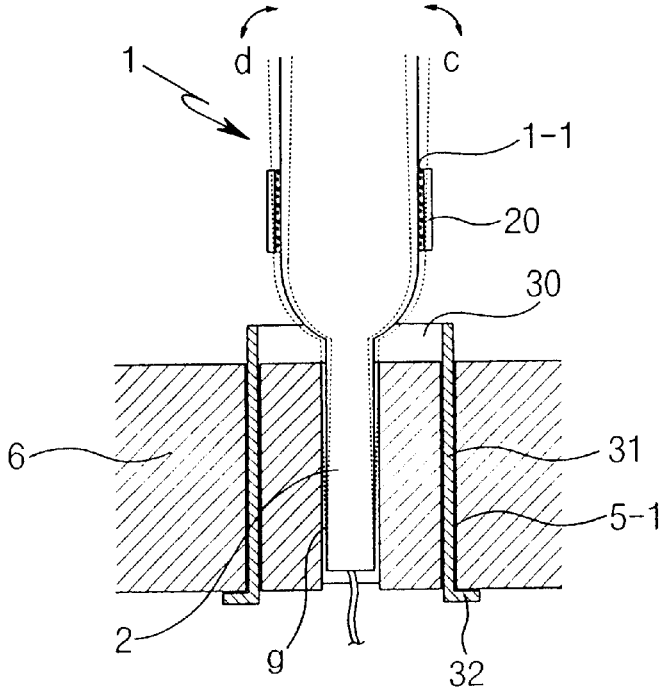
Fig. 6 PRIOR ART
FIG. 6 is an enlarged cross-sectional view taken along the line B—B of FIG. 4.
Figure 7:
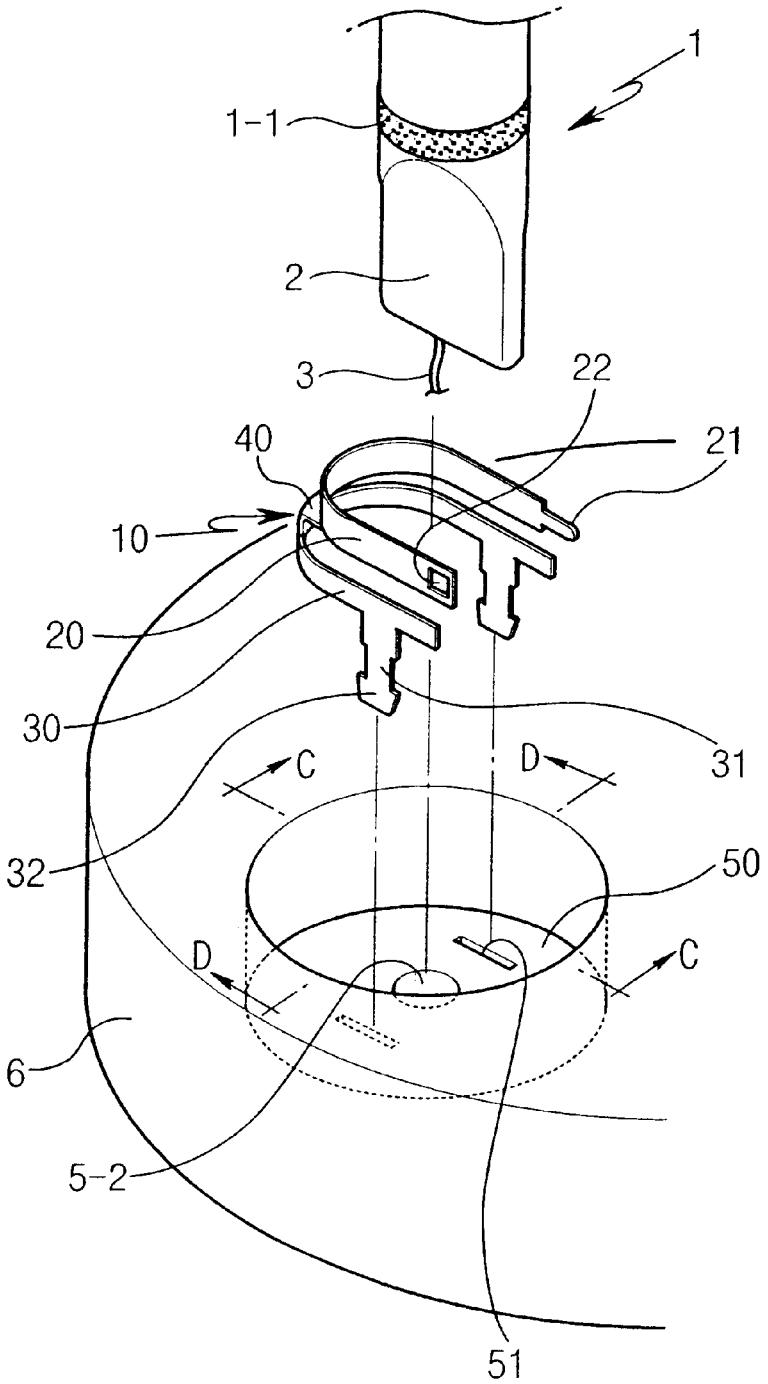
FIG. 7 is an exploded perspective view illustrating a halogen lamp supporting device according to the present invention.
Figure 8:
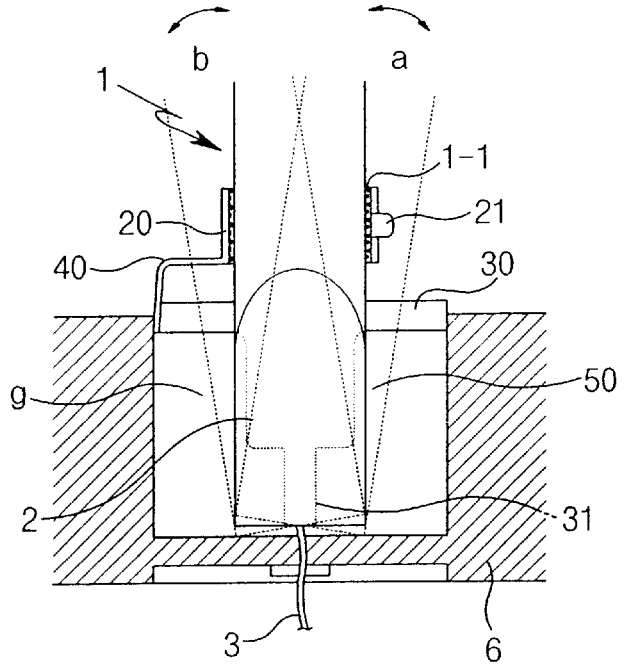
FIG. 8 is an enlarged cross-sectional view taken along the line C—C of FIG. 7.
Figure 9:
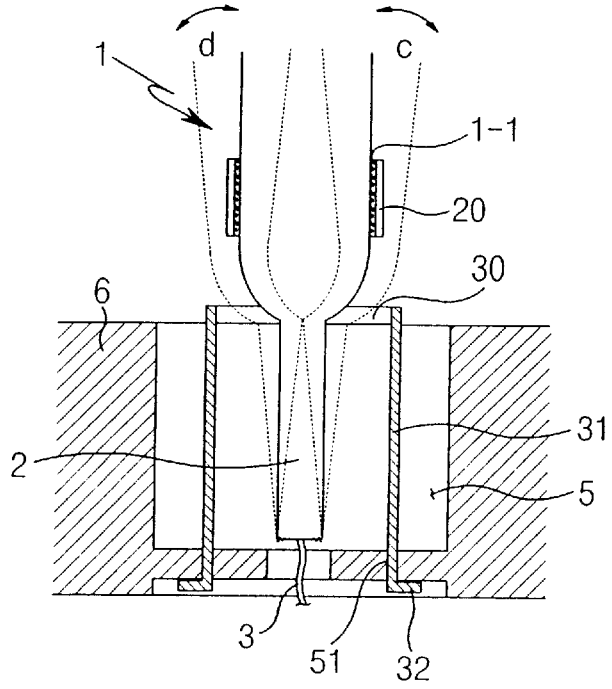
FIG. 9 is an enlarged cross-sectional view taken along the line D—D of FIG. 4.

FIG. 7 is an exploded perspective view illustrating a halogen lamp supporting device in accordance with an embodiment of the present invention; FIG. 8 is a cross-sectional view taken along the line C—C of FIG. 7, illustrating an assembled status of a halogen lamp; and FIG. 9 is a cross-sectional view taken along the line D—D of FIG. 7, illustrating the assembled status of the halogen lamp.

A halogen lamp supporting device in accordance with an embodiment of the present invention includes a base 6 having accommodating holes 50 into which fitting end plates 2 of a halogen lamp 1 are respectively fitted and slits which are defined at opposite sides of each fitting slot 5; and elastic supporting members 10 each having supporting strips 20 and 30 which are tightly fitted around an associated end of the halogen lamp 1 and fixing levers 31 which are integrally formed with one of the supporting strips 20 and 30 and fitted into the slits of the base 6 to support the halogen lamp 1. The accommodating holes 50 are defined in the base 6 at halogen lamp supporting positions, respectively, in a manner such that the fitting end plate 2 of the halogen lamp 1 and the elastic supporting member 10 can be simultaneously accommodated in each accommodating hole 50. Also, the slits 51, into which the fixing levers 31 are to be fitted, are defined on bottom surfaces of the accommodating holes 50.

The reference numeral 1-1 designates an insulating cloth for performing an insulating function when the elastic supporting members 10 are tightly fitted around the associated end of the halogen lamp 1, 3 a wire, 21 a fitting protrusion fitted into a fitting hole 22, 40 a bending piece for vertically coupling the supporting strip 20 and the assistant supporting strip 30 with each other, 32 a fixing protrusion, and 5-2 a wire hole.

In the halogen lamp supporting device according to the present invention, constructed as mentioned above, as can be readily seen from FIG. 7, the base 6 is defined to have a diameter which corresponds to a diameter of the halogen lamp 1 plus a thickness of the elastic supporting member 10. In a state wherein the insulating cloth 1-1 is intervened between the halogen lamp 1 and the supporting strips 20 and 30, the fitting protrusion 21 of the supporting strip 20 is fitted into the fitting hole 22. Then, the fixing levers 31 are respectively fitted into the fixing lever slits 5-1 which are defined on the bottom surfaces of the accommodating holes 5, as shown in FIG. 9. Free ends of the fixing levers 31, which project out of a lower surface of the base 6, are bent sideward to prevent the fixing levers 31 from fluctuating, and the wire 3 is separately connected to a power source.

In the present invention, the elastic support members 10 are not first fitted into the base 6 to be then fitted around the associated end of the halogen lamp 1. Instead, as can be readily seen from FIGS. 8 and 9, the halogen lamp 1 and the elastic support member 10 are simultaneously accommodated in the accommodating hole 50, and therefore, workability is improved. Moreover, since movable angles designated by a, b, c and d are increased, a shock absorbing characteristic is improved.

In particular, as shown in FIG. 9, due to the fact that the fitting end plate 2 is accommodated in the accommodating hole and the accommodating hole 50 has a diameter which substantially corresponds not to a width of the fitting end plate 2 but to a diameter of the halogen lamp 1, as the accommodating hole 50 has a size which is larger than the thickness of the fitting end plate 2, movable angles c and d of the halogen lamp 1 are increased.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

As apparent from the above description, the present invention provides a halogen lamp supporting device in which a halogen lamp is mounted to the base by elastic support members. In accordance with this configuration, it is possible to prevent impact from being directly transmitted between the halogen lamp and the base, thereby preventing the halogen lamp from being damaged. In accordance with the present invention, both the halogen lamp and each elastic support member are fitted in one fitting hole. Accordingly, it is possible to achieve a convenient and easy assembling process while increasing an elastic force for absorbing impact, thereby effectively preventing the halogen lamp from being damaged.

What is claimed is:

1. A halogen lamp supporting device comprising a base having accommodating holes into which fitting end plates of a halogen lamp are respectively fitted and slits which are defined at opposite sides of each fitting slot; and elastic supporting members each having supporting strips which are tightly fitted around an associated end of the halogen lamp and fixing levers which are integrally formed with one of the supporting strips and fitted into the slits of the base to support the halogen lamp, the accommodating holes being defined in the base at halogen lamp supporting positions, respectively, so that the fitting end plate and the elastic supporting member can be simultaneously accommodated in each accommodating hole, and the slits, into which the fixing levers are to be fitted, being defined on bottom surfaces of the accommodating holes.

* * * * *